US005737989A

United States Patent [19]

Sung

[11] Patent Number: 5,737,989

[45] Date of Patent: Apr. 14, 1998

[54] HYDRAULIC PAPER CUTTING MACHINE

[76] Inventor: Huang Ming Sung, P.O. Box 63-150, Taichung, Taiwan

[21] Appl. No.: 773,449

[22] Filed: Dec. 26, 1996

[51] Int. Cl.[6] ..... B26D 1/08

[52] U.S. Cl. ..... 83/625; 83/624

[58] Field of Search ..... 83/613, 624, 625, 83/626, 633, 639.1, 632, 628, 629; 125/23.01, 16.03

[56] References Cited

U.S. PATENT DOCUMENTS 5,570,678 11/1996 Waggoner et al. ..... 83/624

FOREIGN PATENT DOCUMENTS 695590 10/1964 Canada ..... 83/625
416642 11/1938 Germany ..... 83/625

*Primary Examiner*—Maurina T. Rachuba

[57] ABSTRACT

An improved hydraulic paper cutting machine for preventing paper contamination and ensuring operation safety. A hydraulic cylinder is disposed below a machine body and located below the sheet of paper to be cut. The paper will not be contaminated even if the hydraulic cylinder leaks. A stop element is provided on a linkage means to prevent a cutter frame; the stop element may prevent the cutter frame from falling down if the hydraulic cylinder malfunctions and goes out of control, thus ensuring the safety of the operator.

2 Claims, 4 Drawing Sheets

HYDRAULIC PAPER CUTTING MACHINE

BACKGROUND OF THE INVENTION (a). Field of the Invention

The present invention relates generally to a hydraulic paper cutting machine, and more particularly to an improved hydraulic paper cutting machine.

(b). Description of the Prior Art

FIG. 1 shows a conventional hydraulic paper cutting machine. It essentially comprises a machine body 13, a cutter frame 11 having a cutter mounted thereon, the cutter frame 11 being pivotally mounted on the machine body 13 by means of a pair of links 12, and a hydraulic cylinder 14 pivotally mounted on the machine body 13. The hydraulic cylinder 14 has a piston 141 for pivotally connecting to the cutter frame 11. Therefore, by actuating the piston 141 of the hydraulic cylinder 14, the cutter frame 11 may be controlled to displace along a determined track to accomplish continuous cutting of paper. There are however two serious drawbacks with such a conventional hydraulic cutting machines. First, since the hydraulic cylinder 14 is disposed above the sheet paper to be cut, once the hydraulic cylinder 14 leaks due to prolonged use, the leaked oil may drip down onto the paper and contaminate it, so that the paper cannot be used, thus enhancing the cost of paper. Second, once the hydraulic cylinder 14 does not function properly or goes out of control, and there is no sign of warning, the cutter frame 11 may drop down speedily due to loss of support. As a result, the operator's hands and arms may be hurt or, even worse, cut off. The safety of operation in the prior art is therefore a serious problem.

SUMMARY OF THE INVENTION

Accordingly, a primary object of the present invention is to provide an improved hydraulic paper cutting machine wherein a hydraulic cylinder is disposed below the sheet of paper to be cut so that, even if the hydraulic cylinder leaks, the sheet of paper will not be contaminated to result in waste of paper and increase in the cost of paper.

Another object of the present invention is to provide an improved hydraulic paper cutting machine wherein a stop element is provided to prevent a cutter frame from dropping when the hydraulic cylinder malfunctions and goes out of control, thus ensuring the safety of the operators.

In order to achieve the above-mentioned objects, the improved hydraulic paper cutting machine essentially comprises a machine body; a cutter frame having a cutter mounted thereon at a suitable position, the cutter frame being pivotally mounted on the machine body by using link means; a hydraulic cylinder secured on the machine body and having a piston; and a linkage device having one end connected to the piston of the hydraulic cylinder, with the other end pivotally mounted on the cutter frame. The hydraulic cylinder is fixedly secured below the machine body and located below a sheet of paper to be cut, and the piston thereof is provided with a rack. The linkage device comprises a drive gear, a pivot shaft, a transmission gear, a pair of cams and a crank. The drive gear is pivotally mounted on the machine body to be just engaging the teeth of the rack on the piston the pivot shaft has both ends respectively pivotally mounted on the machine body. The transmission gear is fixedly secured on the pivot shaft with a plurality of teeth engaging a plurality of teeth of the drive gear. The cams are fixedly secured on the pivot shaft just located at one side of aid transmission gear, the cams being spaced a predetermined distance from each other. The crank has one end thereof pivotally provided between the cams by use of a pin with the other end thereof pivotally mounted on the cutter frame. When the piston of the hydraulic cylinder reciprocates and, via the linking-up movement of the drive gear, the pivot shaft, the transmission gear, the cams and the crank, causes the cutter frame to move up and down in a reciprocating manner to smoothly accomplishing cutting of the sheet of paper.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
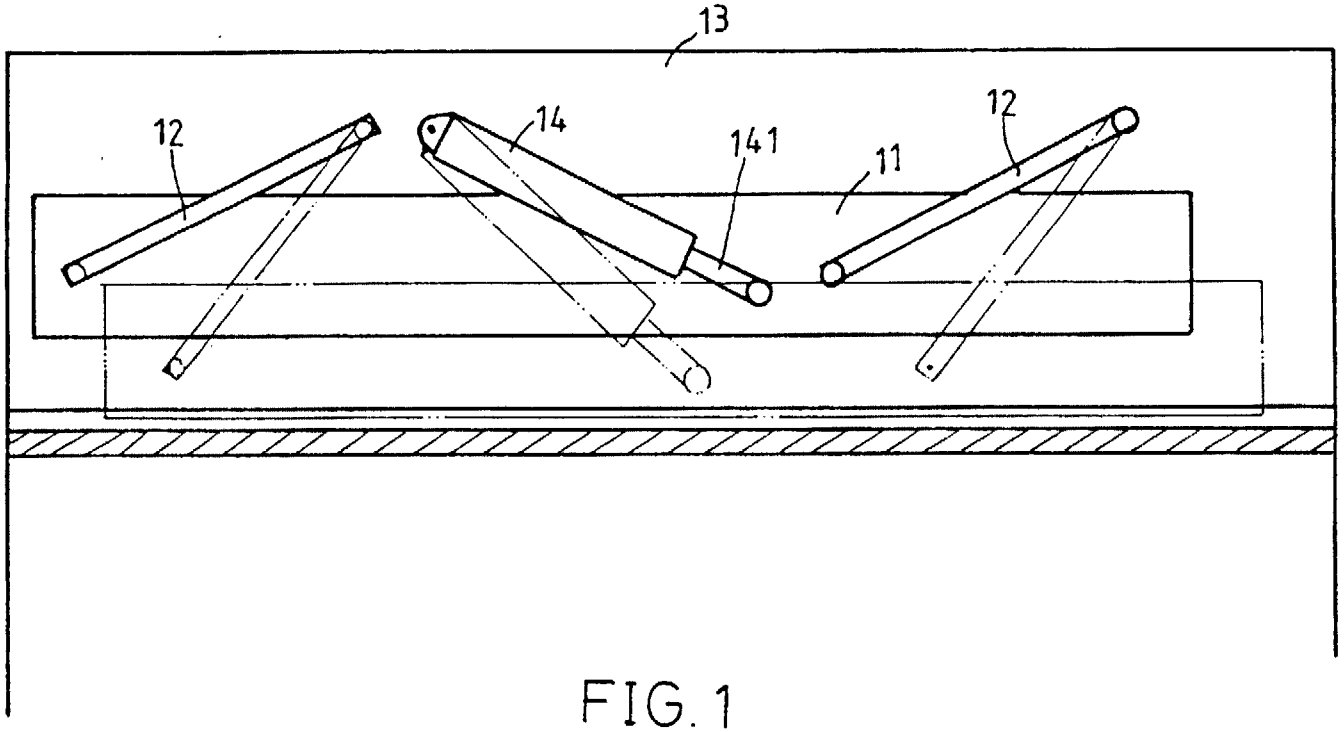
FIG. 1 PRIOR ART
FIG. 1 is a schematic plan view of a conventional hydraulic paper cutting machine.
Figure 2:
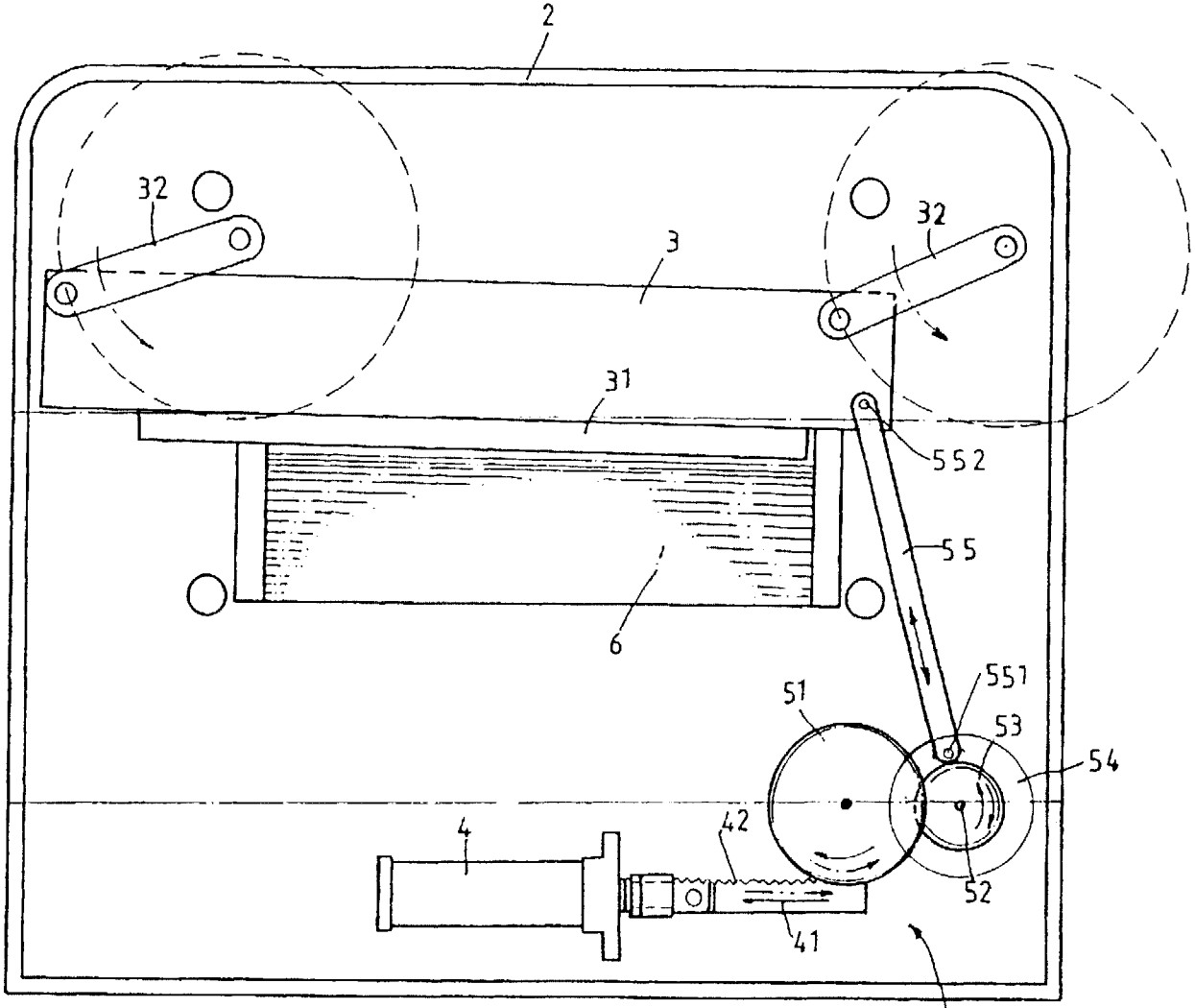
FIG. 2 is a schematic assembled view of the present invention.
Figure 3:
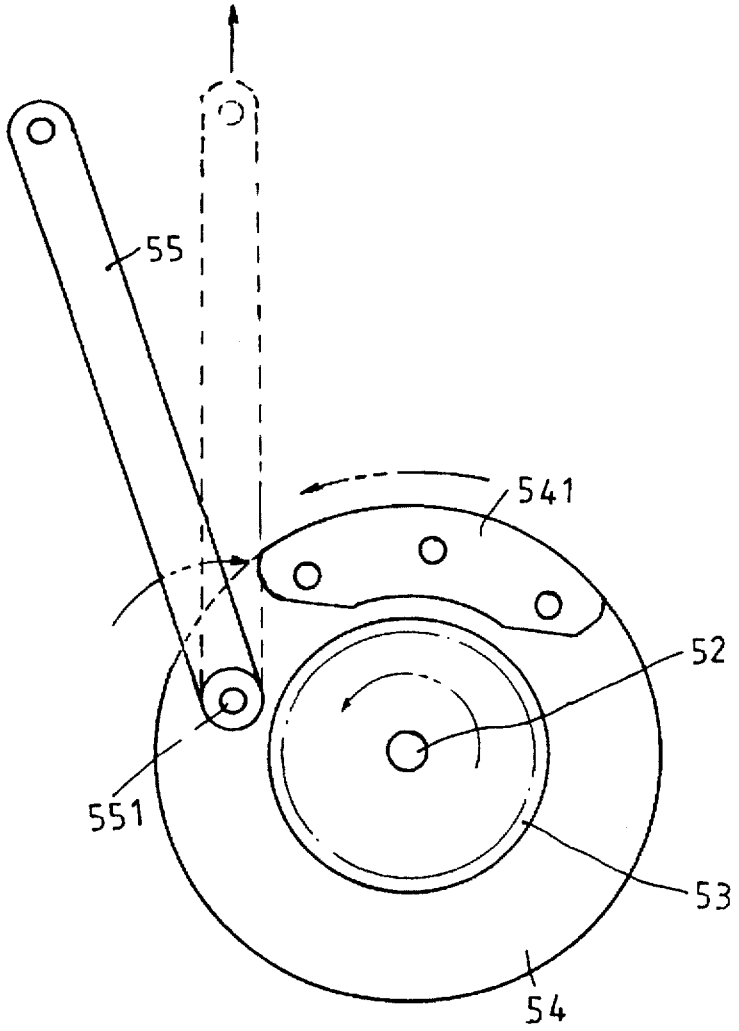
FIG. 3 is a front view of a drive device of the present invention.
Figure 4:
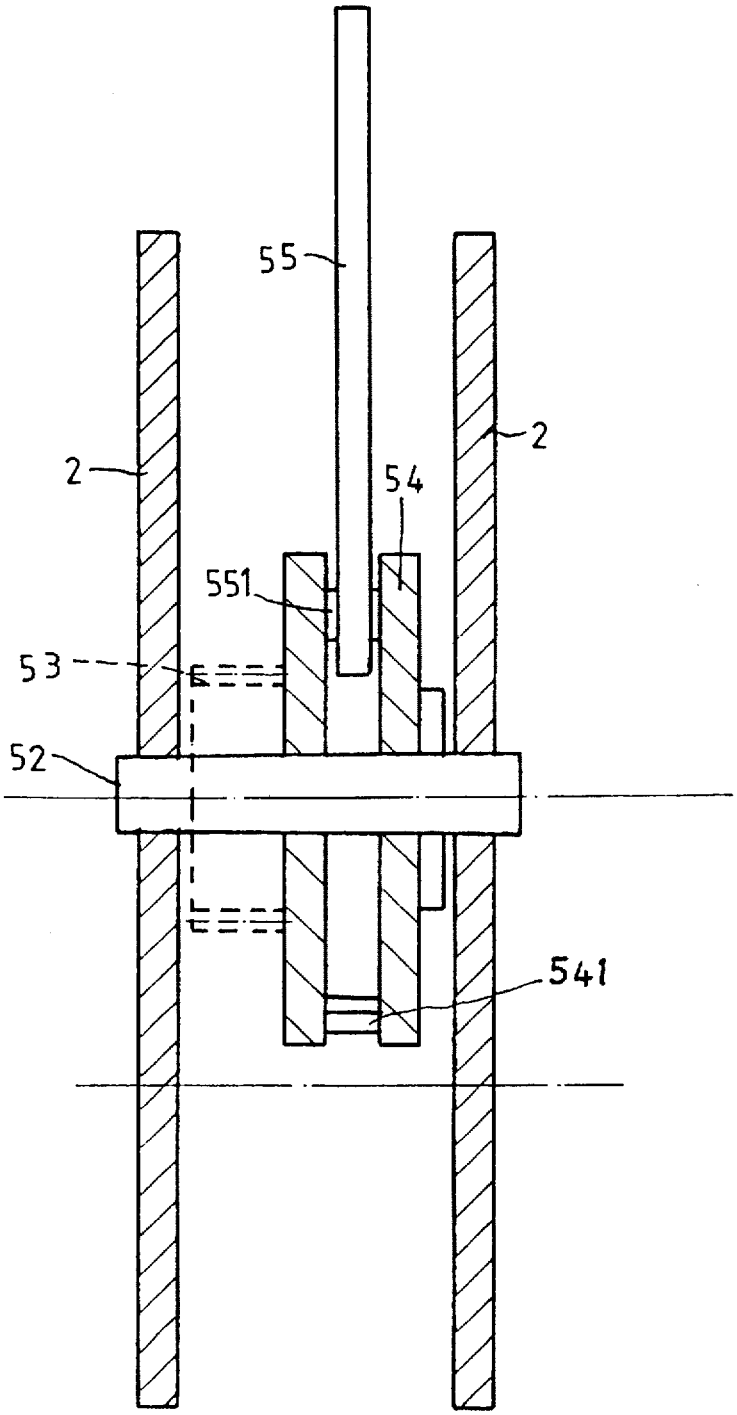
FIG. 4 is a schematic side view of the drive device of the present invention.

With reference to FIGS. 2, 3 and 4, the improved hydraulic paper cutting machine according to the present invention essentially comprises a machine body 2, a cutter frame 3, a hydraulic cylinder 4, and a linkage device 5.

The cutter frame 3 is provided with a cutter 31 at a suitable position, which may be pivotally mounted on the machine body 2 by use of link means 32.

The hydraulic cylinder 4 is fixedly mounted on the machine body 2. In the preferred embodiment of the present invention, the hydraulic cylinder 4 is fixedly disposed below the machine body 2, i.e., located below a sheet of paper 6 to be cut. The hydraulic cylinder 4 is further provided with a piston 41 having a rack 42.

The linkage device 5 has one end connected to the piston 41 of the hydraulic cylinder 4 with the other end pivotally disposed on the cutter frame 3. In this preferred embodiment of the invention, the linkage device 5 comprises a drive gear 51, a pivot 52, a transmission gear 53, a pair of cams 54, and a crank 55. The drive gear 51 is pivotally mounted on the machine body 2 just engaging the rack 42 of the piston 41. The pivot 52 has both ends respectively disposed on the machine body 2. The transmission gear 53 is fixedly disposed on the pivot 52 and has a plurality of teeth 531 for engaging a plurality of 511 of the drive gear 51. The cams 53 are likewise fixedly provided on the pivot 52, just located at one side of the drive gear 53, and they are spaced a predetermined distance apart from each other. The crank 55 has one end pivotally mounted between the cams 54 at a suitable position by means of a pin 551, with the other end pivotally disposed on the cutter frame 3.

In operation, the sheet of paper 6 to be cut should be properly positioned first. After turning on the power, the piston 41 of the hydraulic cylinder 4 will reciprocate, bringing the drive gear 51 engaged therewith to reciprocate through a predetermined distance while rotating. Certainly, the transmission gear 52 engaging the drive gear 51 will also rotate reciprocatingly through a predetermined distance using the pivot 52 as its axis. As a result of power transmission, the cams sharing the same pivot 52 with the transmission gear 53 will also rotate while traveling back and forth through a predetermined distance. Via the link-up movement of the crank 55, the cutter frame 3 will reciprocate continuously, and the cutter 311 on the he cutter frame 3 will smoothly complete the job of cutting the sheet of paper 6. The operation is entirely smooth, precise and allows no errors.

In addition, with reference to FIG. 4, the present invention has taken into consideration the safety in operation. Since the hydraulic cylinder 4, which is located below the machine body 2, travels back and forth in a horizontal line, and since the drive gear 51 is controlled by the fixed travel of the reciprocating rack 42, the piovtal rotation of the drive gear 51 will be restricted so that it may only turn leftward or rightward within a specific angle. The present invention exploits this rotating force within such an angle to drive the transmission gear 53 engaging with the drive gear 51. And the crank 55 eccentrically disposed on the cams 54 is used to guide the motion of the cutter frame 3 upwardly or downwardly. A biggest advantage of such an arrangement is that even if the hydraulic cylinder 4 leaks there is at most only some changes in the forward and rearward travel distances of the rack 42. The function of the rack 42 here is only a medium of power transmission. Basically, the influence it has on the ultimate travel of the cutter frame 3 is very limited. This can be seen from FIG. 2 in which when the rack 42 stops after it has reached its extreme limit, the gears originally engaging therewith are basically still engaging each other and fixed in their positions. The crank 55 remains stationary no matter at whatever angles of elevation and keeps on supporting the cutter frame 3 above to prevent it from slipping downwardly. Therefore, the uncontrollable situations happened as a result of leakage of the hydraulic cylinder in the prior art can be eliminated.

With reference to FIGS. 3 and 4, in order to ensure 100 percent work safety, the present invention further comprises a stop element 541 locked between the pair of cams 54. The stop element 541 basically may pivotally displace in a synchronously manner with the cams 54 to which it is secured and the transmission gear 53. However, if the hydraulic cylinder 4 is seriously out of control, the rack 42 serving as a stop means in a level position cannot give full play to its functions, the transmission gear 53 originally engaging therewith will deflect through an excessive angle. But due to the crank 55 connecting the cams 54 still pivotally displace in the direction of the cams 54, as shown by imaginary lines in FIG. 3, the final result will be that, when the cams 54 has turned such that the stop element 541 secured at one side thereof thwarts across the body of the crank 55, together with the upper portion of the crank 55 and the pivot joint one the cutter frame 3, three points of support may thus be constituted to strongly support the cutter frame 3 above to prevent the cutter 31 from falling down. The safety of the operator may be absolutely ensured.

In the present invention, as the hydraulic cylinder is placed at a suitable position below the paper to be cut, even if the hydraulic cylinder leaks, the paper to be cut will not be contaminated. Furthermore, the stop element of the invention serves to effectively support the cutter frame during any malfunctioning of the hydraulic cylinder to perfectly ensure safety of the operators.

Although the present invention has been illustrated and described with reference to the preferred embodiment thereof, it should be understood that it is in no way limited to the details of such embodiment but is capable of numerous modifications within the scope of the appended claims.

What is claimed is:

1. A hydraulic paper cutting machine, comprising:

a machine body;

a cutter frame having a cutter mounted thereon at a suitable position, said cutter frame being pivotally mounted on said machine body by using link means;

a hydraulic cylinder secured on said machine body and having a piston; and a linkage device having one end connected to said piston of said hydraulic cylinder, with the other end pivotally mounted on said cutter frame; wherein said hydraulic cylinder is fixedly secured below said machine body and located below a sheet of paper to be cut, and said piston thereof is provided with a rack; said linkage device comprises a drive gear, a pivot shaft, a transmission gear, a pair of cams and a crank, in which said drive gear is pivotally mounted on said machine body to be just engaging the teeth of said rack on said piston; said pivot shaft has both ends respectively pivotally mounted on said machine body; said transmission gear is fixedly secured on said pivot shaft with a plurality of teeth engaging a plurality of teeth of said drive gear; said cams are fixedly secured on said pivot shaft just located at one side of aid transmission gear, said cams being spaced a predetermined distance from each other and said crank has one end thereof pivotally provided between said cams by use of a pin with the other end thereof pivotally mounted on said cutter frame; whereby when said piston of said hydraulic cylinder reciprocates and, via the linking-up movement of said drive gear, said pivot shaft, said transmission gear, said cams and said crank, causes said cutter frame to move up and down in a reciprocating manner to smoothly accomplishing cutting of the sheet of paper.

2. A hydraulic paper cutting machine as claimed in claim 1, wherein a stop element is lockably disposed between said cams at a suitable position so that, if said hydraulic cylinder goes out of control, said stop element may timely urge against said crank to stop said cutter frame from falling down, thus providing safety in operation.

* * * * *